US007908815B2

(12) United States Patent
Pervan et al.

(10) Patent No.: US 7,908,815 B2
(45) Date of Patent: Mar. 22, 2011

(54) MECHANICAL LOCKING OF FLOOR PANELS WITH A FLEXIBLE BRISTLE TONGUE

(75) Inventors: Darko Pervan, Viken (SE); Agne Paisson, Hasslarp (SE)

(73) Assignee: Valinge Innovation AB, Viken (SE)

( * ) Notice: Subject to any disclaimer, the term of this patent is extended or adjusted under 35 U.S.C. 154(b) by 788 days.

(21) Appl. No.: 11/775,885

(22) Filed: Jul. 11, 2007

(65) Prior Publication Data

US 2008/0104921 A1 May 8, 2008

Related U.S. Application Data

(63) Continuation-in-part of application No. PCT/SE2006/001218, filed on Oct. 27, 2006.

(60) Provisional application No. 60/806,975, filed on Jul. 11, 2006.

(30) Foreign Application Priority Data

Jul. 11, 2006 (SE) ..... 0601550

(51) Int. Cl.
*E04B 2/00* (2006.01)

(52) U.S. Cl. ..... 52/582.1; 52/391; 52/588.1; 428/50

(58) Field of Classification Search ..... 52/588.1, 52/582.1, 582.2, 587.1, 586.1, 586.2, 585.1, 52/578, 390, 392, 533, 534, 539, 553, 589.1, 52/590.2, 590.3, 591.1, 591.2, 591.3, 591.4, 52/591.5, 592.1, 582.4, 745.08, 745.19, 747.1, 52/747.11, 748.1, 748.11; 403/334, 345, 403/364–368, 372, 375, 376, 381; 404/34, 404/35, 40, 41, 46, 47, 49–58, 68, 70; 428/44, 428/47–50, 57, 58, 60, 61, 106, 192–194
See application file for complete search history.

(56) References Cited

U.S. PATENT DOCUMENTS

| | | | |
|---|---|---|---|
| 124,228 | A | 3/1872 | Stuart |
| 1,723,306 | A | 8/1929 | Sipe |
| 1,743,492 | A | 1/1930 | Sipe |
| 1,787,027 | A | 12/1930 | Wasleff |
| 1,809,393 | A | 6/1931 | Rockwell |
| 1,902,716 | A | 3/1933 | Newton |
| 1,925,070 | A | 8/1933 | Livezey |
| 1,995,264 | A | 3/1935 | Mason |
| 2,015,813 | A | 10/1935 | Nielsen |

(Continued)

FOREIGN PATENT DOCUMENTS

CA 2 456 513 A1 2/2003

(Continued)

OTHER PUBLICATIONS

Pervan, et al., U.S. Appl. No. 12/518,584, entitled, "Mechanical Locking of Floor Panels," filed in the U. S. Patent and Trademark Office on Jun. 10, 2009.

Pervan, Darko, et al., U.S. Appl. No. 12/518,584, entitled, "Mechanical Locking of Floor Panels," Jun. 10, 2009.

International Search Report issued in corres. PCT/SE2006/001218 (Published as WO 2007/015669 A3), Apr. 25, 2007, Swedish Patent Office, Stockholm, SE.

Boo, U.S. Appl. No. 12/362,977, entitled "Mechanical Locking of Floor Panels", filed Jan. 30, 2009.

Pervan, Darko, et al., U.S. Appl. No. 12/868,137, entitled "Mechanical Locking System for Floor Panels," filed in the U. S. Patent and Trademark Office on Aug. 25, 2010.

*Primary Examiner* — Richard E Chilcot, Jr.
*Assistant Examiner* — William V Gilbert
(74) *Attorney, Agent, or Firm* — Buchanan Ingersoll & Rooney PC

(57) ABSTRACT

Floor panels are provided with a mechanical locking system including a displaceable tongue in a displacement groove. The tongue is molded and provided with bendable protrusions.

29 Claims, 8 Drawing Sheets

U.S. PATENT DOCUMENTS

| | | | |
|---|---|---|---|
| 2,026,511 | A | 12/1935 | Storm |
| 2,088,238 | A | 7/1937 | Greenway |
| 2,089,075 | A | 8/1937 | Siebs |
| 2,204,675 | A | 9/1937 | Grunert |
| 2,303,745 | A | 12/1942 | Karreman |
| 2,430,200 | A | 11/1947 | Wilson |
| 2,596,280 | A | 5/1952 | Nystrom |
| 2,732,706 | A | 1/1956 | Friedman |
| 2,740,167 | A | 4/1956 | Rowley |
| 2,865,058 | A | 12/1958 | Andersson |
| 3,023,681 | A | 3/1962 | Worson |
| 3,077,703 | A | 2/1963 | Bergstrom |
| 3,325,585 | A | 6/1967 | Brenneman |
| 3,378,958 | A | 4/1968 | Parks et al. |
| 3,436,888 | A | 4/1969 | Ottosson |
| 3,512,324 | A | 5/1970 | Reed |
| 3,517,927 | A | 6/1970 | Kennel |
| 3,526,071 | A | 9/1970 | Watanabe |
| 3,535,844 | A | 10/1970 | Glaros |
| 3,554,850 | A | 1/1971 | Kuhle |
| 3,572,224 | A | 3/1971 | Perry |
| 3,579,941 | A | 5/1971 | Tibbals |
| 3,720,027 | A | 3/1973 | Christensen |
| 3,731,445 | A | 5/1973 | Hoffmann et al. |
| 3,742,669 | A | 7/1973 | Mansfeld |
| 3,760,547 | A | 9/1973 | Brenneman |
| 3,849,235 | A | 11/1974 | Gwynne |
| 3,919,820 | A | 11/1975 | Green |
| 4,082,129 | A | 4/1978 | Morelock |
| 4,100,710 | A | 7/1978 | Kowallik |
| 4,107,892 | A | 8/1978 | Bellem |
| 4,113,399 | A | 9/1978 | Hansen, Sr. |
| 4,169,688 | A | 10/1979 | Toshio |
| 4,196,554 | A | 4/1980 | Anderson |
| 4,299,070 | A | 11/1981 | Oltmanns et al. |
| 4,304,083 | A | 12/1981 | Anderson |
| 4,426,820 | A | 1/1984 | Terbrack et al. |
| 4,512,131 | A | 4/1985 | Laramore |
| 4,599,841 | A | 7/1986 | Haid |
| 4,819,932 | A | 4/1989 | Trotter, Jr. |
| 5,007,222 | A | 4/1991 | Raymond |
| 5,135,597 | A | 8/1992 | Barker |
| 5,148,850 | A | 9/1992 | Urbanick |
| 5,182,892 | A | 2/1993 | Chase |
| 5,247,773 | A | 9/1993 | Weir |
| 5,295,341 | A | 3/1994 | Kajiwara |
| 5,344,700 | A | 9/1994 | McGath et al. |
| 5,349,796 | A | 9/1994 | Meyerson |
| 5,465,546 | A | 11/1995 | Buse |
| 5,548,937 | A | 8/1996 | Shimonohara |
| 5,577,357 | A | 11/1996 | Civelli |
| 5,598,682 | A | 2/1997 | Haughian |
| 5,618,602 | A | 4/1997 | Nelson |
| 5,634,309 | A | 6/1997 | Polen |
| 5,694,730 | A | 12/1997 | Del Rincon et al. |
| 5,755,068 | A | 5/1998 | Ormiston |
| 5,860,267 | A | 1/1999 | Pervan |
| 5,899,038 | A | 5/1999 | Stroppiana |
| 5,950,389 | A | 9/1999 | Porter |
| 6,006,486 | A | 12/1999 | Moriau |
| 6,052,960 | A | 4/2000 | Yonemura |
| 6,065,262 | A | 5/2000 | Motta |
| 6,173,548 | B1 | 1/2001 | Hamar et al. |
| 6,182,410 | B1 | 2/2001 | Pervan |
| 6,203,653 | B1 | 3/2001 | Seidner |
| 6,216,409 | B1 | 4/2001 | Roy et al. |
| 6,254,301 | B1 | 7/2001 | Hatch |
| 6,314,701 | B1 | 11/2001 | Meyerson |
| 6,332,733 | B1 | 12/2001 | Hamberger et al. |
| 6,358,352 | B1 | 3/2002 | Schmidt |
| 6,363,677 | B1 | 4/2002 | Chen et al. |
| 6,385,936 | B1 | 5/2002 | Schneider |
| 6,418,683 | B1 | 7/2002 | Martensson et al. |
| 6,446,413 | B1 | 9/2002 | Gruber |
| 6,450,235 | B1 | 9/2002 | Lee et al. |
| 6,490,836 | B1 | 12/2002 | Moriau |
| 6,505,452 | B1 | 1/2003 | Hannig |
| 6,536,178 | B1 | 3/2003 | Palsson et al. |
| 6,553,724 | B1 | 4/2003 | Bigler |
| 6,576,079 | B1 | 6/2003 | Kai |
| 6,591,568 | B1 | 7/2003 | Palsson |
| 6,601,359 | B2 | 8/2003 | Olofsson |
| 6,647,689 | B2 | 11/2003 | Heitzinger |
| 6,647,690 | B1 | 11/2003 | Martensson |
| 6,729,091 | B1 | 5/2004 | Martensson |
| 6,763,643 | B1 | 7/2004 | Martensson |
| 6,769,219 | B2 | 8/2004 | Schwitte et al. |
| 6,854,235 | B2 * | 2/2005 | Martensson ..... 52/601 |
| 6,865,855 | B2 | 3/2005 | Knauseder |
| 7,040,068 | B2 | 5/2006 | Moriau et al. |
| 7,051,486 | B2 | 5/2006 | Pervan |
| 7,127,860 | B2 | 10/2006 | Pervan et al. |
| 7,275,350 | B2 | 10/2007 | Pervan et al. |
| 7,377,081 | B2 | 5/2008 | Ruhdorfer |
| 7,454,875 | B2 | 11/2008 | Pervan et al. |
| 7,568,322 | B2 | 8/2009 | Pervan |
| 7,584,583 | B2 | 9/2009 | Bergelin et al. |
| 7,614,197 | B2 | 11/2009 | Nelson |
| 2002/0007608 | A1 | 1/2002 | Pervan |
| 2002/0007609 | A1 | 1/2002 | Pervan |
| 2002/0031646 | A1 | 3/2002 | Chen et al. |
| 2002/0056245 | A1 | 5/2002 | Thiers |
| 2002/0083673 | A1 | 7/2002 | Kettler et al. |
| 2002/0092263 | A1 | 7/2002 | Schulte |
| 2002/0178674 | A1 | 12/2002 | Pervan |
| 2002/0178680 | A1 * | 12/2002 | Martensson et al. ..... 52/578 |
| 2003/0009971 | A1 | 1/2003 | Palmberg |
| 2003/0024199 | A1 | 2/2003 | Pervan |
| 2003/0037504 | A1 | 2/2003 | Schwitte et al. |
| 2003/0084636 | A1 | 5/2003 | Pervan |
| 2003/0101674 | A1 | 6/2003 | Pervan et al. |
| 2003/0101681 | A1 | 6/2003 | Tychsen |
| 2003/0180091 | A1 | 9/2003 | Stridsman |
| 2003/0188504 | A1 | 10/2003 | Ralf |
| 2003/0196405 | A1 | 10/2003 | Pervan |
| 2004/0031227 | A1 | 2/2004 | Knauseder |
| 2004/0060255 | A1 | 4/2004 | Knauseder |
| 2004/0068954 | A1 | 4/2004 | Martensson |
| 2004/0168392 | A1 | 9/2004 | Konzelmann et al. |
| 2004/0182036 | A1 | 9/2004 | Sjoberg |
| 2004/0200175 | A1 | 10/2004 | Weber |
| 2004/0211143 | A1 | 10/2004 | Hannig |
| 2004/0261348 | A1 | 12/2004 | Vulin |
| 2005/0160694 | A1 | 7/2005 | Pervan |
| 2005/0210810 | A1 | 9/2005 | Pervan |
| 2005/0235593 | A1 | 10/2005 | Hecht |
| 2005/0252130 | A1 | 11/2005 | Martensson |
| 2006/0032168 | A1 | 2/2006 | Thiers et al. |
| 2006/0070333 | A1 | 4/2006 | Pervan |
| 2006/0101769 | A1 | 5/2006 | Pervan et al. |
| 2006/0236642 | A1 | 10/2006 | Pervan |
| 2006/0260254 | A1 | 11/2006 | Pervan |
| 2007/0006543 | A1 | 1/2007 | Engstrom |
| 2007/0028547 | A1 | 2/2007 | Grafenauer |
| 2007/0108679 | A1 * | 5/2007 | Grothaus ..... 267/158 |
| 2007/0151189 | A1 | 7/2007 | Yang |
| 2007/0193178 | A1 | 8/2007 | Groeke et al. |
| 2007/0209736 | A1 | 9/2007 | Deringor |
| 2008/0000185 | A1 | 1/2008 | Duerenberger |
| 2008/0000186 | A1 | 1/2008 | Pervan et al. |
| 2008/0010931 | A1 | 1/2008 | Pervan et al. |
| 2008/0010937 | A1 | 1/2008 | Pervan et al. |
| 2008/0028707 | A1 | 2/2008 | Pervan |
| 2008/0034708 | A1 | 2/2008 | Pervan |
| 2008/0041008 | A1 | 2/2008 | Pervan |
| 2008/0066415 | A1 | 3/2008 | Pervan et al. |
| 2008/0110125 | A1 | 5/2008 | Pervan |
| 2008/0134607 | A1 | 6/2008 | Pervan et al. |
| 2008/0134613 | A1 | 6/2008 | Pervan |
| 2008/0134614 | A1 | 6/2008 | Pervan et al. |
| 2008/0155930 | A1 | 7/2008 | Pervan et al. |
| 2008/0172971 | A1 | 7/2008 | Pervan |
| 2008/0216434 | A1 | 9/2008 | Pervan |
| 2008/0216920 | A1 | 9/2008 | Pervan |
| 2008/0236088 | A1 | 10/2008 | Hannig |
| 2008/0295432 | A1 | 12/2008 | Pervan et al. |
| 2009/0193748 | A1 | 8/2009 | Boo et al. |

FOREIGN PATENT DOCUMENTS

| | | | |
|---|---|---|---|
| DE | 2 159 042 | A1 | 6/1973 |
| DE | 33 43 601 | A1 | 6/1985 |
| DE | 33 43 601 | C2 | 6/1985 |
| DE | 4 215 273 | A1 | 11/1993 |
| DE | 4 242 530 | A1 | 6/1994 |
| DE | 196 01 322 | A1 | 5/1997 |
| DE | 199 40 837 | A1 | 11/2000 |
| DE | 199 58 225 | A1 | 6/2001 |
| DE | 10 2004 001 363 | A1 | 8/2005 |
| EP | 0 013 852 | A1 | 8/1980 |
| EP | 0 652 340 | A1 | 5/1995 |
| EP | 0 974 713 | A1 | 1/2000 |
| EP | 1 120 515 | A1 | 8/2001 |
| EP | 1 146 182 | A2 | 10/2001 |
| EP | 1 308 577 | A2 | 5/2003 |
| EP | 1 350 904 | A2 | 10/2003 |
| EP | 1 350 904 | A3 | 10/2003 |
| EP | 1 640 530 | A2 | 3/2006 |
| EP | 1 650 375 | A1 | 4/2006 |
| FR | 1.138.595 | | 6/1957 |
| FR | 2 256 807 | | 8/1975 |
| FR | 2 810 060 | A1 | 12/2001 |
| GB | 2 051 916 | A | 1/1981 |
| JP | 3-110258 | A | 5/1991 |
| JP | 6-146553 | A | 5/1994 |
| JP | 7-310426 | A | 11/1995 |
| JP | 10-219975 | A | 8/1998 |
| WO | WO 94/26999 | A1 | 11/1994 |
| WO | WO 96/27719 | A1 | 9/1996 |
| WO | WO 96/27721 | A1 | 9/1996 |
| WO | WO 97/47834 | A1 | 12/1997 |
| WO | WO 98/38401 | A1 | 9/1998 |
| WO | WO 99/66151 | A1 | 12/1999 |
| WO | WO 99/66152 | A1 | 12/1999 |
| WO | WO 00/20705 | A1 | 4/2000 |
| WO | WO 00/20706 | A1 | 4/2000 |
| WO | WO 00/47841 | A1 | 8/2000 |
| WO | WO 01/02672 | A1 | 1/2001 |
| WO | WO 01/07729 | A1 | 2/2001 |
| WO | WO 01/51732 | A1 | 7/2001 |
| WO | WO 01/66877 | A1 | 9/2001 |
| WO | WO 01/77461 | A1 | 10/2001 |
| WO | WO 01/98604 | A1 | 12/2001 |
| WO | WO 02/055809 | A1 | 7/2002 |
| WO | WO 02/055810 | A1 | 7/2002 |
| WO | WO 03/016654 | A1 | 2/2003 |
| WO | WO 03/025307 | A1 | 3/2003 |
| WO | WO 03/083234 | A1 | 10/2003 |
| WO | WO 03/087497 | A1 | 10/2003 |
| WO | WO 03/089736 | A1 | 10/2003 |
| WO | WO 2004/020764 | A1 | 3/2004 |
| WO | WO 2004/079130 | A1 | 9/2004 |
| WO | WO 2004/083557 | A1 | 9/2004 |
| WO | WO 2005/054599 | A1 | 6/2005 |
| WO | WO 2006/043893 | A1 | 4/2006 |
| WO | WO 2006/050928 | A1 | 5/2006 |
| WO | WO 2006/104436 | A1 | 10/2006 |
| WO | WO 2007/015669 | A1 | 2/2007 |

* cited by examiner

Prior Art

Prior Art

Prior Art

Prior Art

MECHANICAL LOCKING OF FLOOR PANELS WITH A FLEXIBLE BRISTLE TONGUE

CROSS-REFERENCE TO RELATED APPLICATIONS

The present application is a continuation-in-part of PCT/SE2006/001218, filed on Oct. 27, 2006, and claims the benefit of U.S. provisional application Ser. No. 60/806,975, filed in the U.S. on Jul. 11, 2006. The present application also claims priority of SE 060550-7, filed in Sweden on Jul. 11, 2007. The present application hereby incorporates herein by reference the subject matter of U.S. patent application Ser. No. 10/970,282; U.S. patent application Ser. No. 11/092,748; PCT/SE2006/001218; U.S. provisional application Ser. No. 60/806,975; and SE 060550-7.

AREA OF INVENTION

The invention generally relates to the field of floor panels with mechanical locking systems with a flexible and displaceable tongue. The invention also relates to a partly bendable tongue for a building panel with such a mechanical locking system.

BACKGROUND

In particular, yet not restrictive manner, the invention concerns a tongue for a floor panel and a set of floor panels mechanically joined to preferably a floating floor. However, the invention is as well applicable to building panels in general. More particularly invention relates to the type of mechanically locking systems comprising a flexible or partly flexible tongue and/or displaceable tongue, in order to facilitate the installation of building panels A floor panel of this type is presented in WO2006/043893, which discloses a floor panel with a locking system comprising a locking element cooperating with a locking groove, for horizontal locking, and a flexible tongue cooperating with a tongue groove, for locking in a vertical direction. The flexible tongue bends in the horizontal plane during connection of the floor panels and makes it possible to install the panels by vertical folding or solely by vertical movement. By "vertical folding" is meant a connection of three panels where a first and second panel are in a connected state and where a single angling action connects two perpendicular edges of a new panel, at the same time, to the first and second panel. Such a connection takes place for example when a long side of the first panel in a first row is already connected to a long side of a second panel in a second row. The third panel is then connected by angling to the long side of the first panel in the first row. This specific type of angling action, which also connects the short side of the new panel and second panel, is referred to as "vertical folding". It is also possible to connect two panels by lowering a whole panel solely by vertical movement against another panel.

Similar floor panels are further described in WO2003/016654, which discloses locking system comprising a tongue with a flexible tab. The tongue is extending and bending essentially in a vertical direction and the tip of the tab cooperates with a tongue groove for vertical locking.

DEFINITION OF SOME TERMS

In the following text, the visible surface of the installed floor panel is called "front face", while the opposite side of the floor panel, facing the sub floor, is called "rear face". The edge between the front and rear face is called "joint edge". By "horizontal plane" is meant a plane, which extends parallel to the outer part of the surface layer. Immediately juxtaposed upper parts of two adjacent joint edges of two joined floor panels together define a "vertical plane" perpendicular to the horizontal plane.

By "joint" or "locking system" are meant co acting connecting means, which connect the floor panels vertically and/or horizontally. By "mechanical locking system" is meant that joining can take place without glue. Mechanical locking systems can in many cases also be combined with gluing. By "integrated with" means formed in one piece with the panel or factory connected to the panel.

By a "flexible tongue" is meant a separate tongue which has a length direction along the joint edges and which is forming a part of the vertical locking system and could be displaced horizontally during locking. The tongue could for example be bendable or have a flexible and resilient part in such a way that it can bend along its length and spring back to its initial position.

By "angling" is meant a connection that occurs by a turning motion, during which an angular change occurs between two parts that are being connected, or disconnected. When angling relates to connection of two floor panels, the angular motion takes place with the upper parts of joint edges at least partly being in contact with each other, during at least part of the motion.

SUMMARY

The present invention relates to a set of floor panels or a floating flooring and tongue for a floor panel, which provides for new embodiments according to different aspects offering respective advantages. Useful areas for the invention are floor panels of any shape and material e.g. laminate, wood, HDF, veneer or stone.

According to a first object, an embodiment of the invention provides for a set of floor panels comprising a front face, a rear face, and a mechanical locking system at two adjacent edges of a first and a second panel, whereby the locking system is configured to connect a first panel to a second panel in the horizontal and vertical plane. The locking system is provided, in order to facilitate the installation, with a displaceable tongue for locking in the vertical plane. The tongue is displaceable in a displacement groove in the edge of one of the floor panels and is configured to cooperate with a tongue groove in the other of said floor panels. A first long edge of the tongue comprises at least two bendable protrusions extending essentially and bendable in the horizontal plane. A second long edge of the tongue, which in the connected state extends outside the displacement groove, has an essentially straight outer edge over substantially the whole length of the tongue.

As the floor panel according to the first embodiment of the invention is provided with a displaceable tongue with bendable protrusions and an essentially straight outer edge this offers several advantages. A first advantage consists in that the floor panels are locked in the vertical direction along substantially the whole length of the tongue. A second advantage is that it is possible to mould the tongues in one part in e.g. plastic material and if desired to cut them up in shorter tongues, which all have essentially the same properties. The same moulding tool could be used to produce flexible tongues for different panel widths. Especially the displacement resistance and the locking strength per length unit could be achieved. A third advantage is that the displacement resistance, due to the bending of the protrusions are essentially the same along the whole tongue. A larger number of protrusions provides for a more constant displacement resistance along the edge of the tongue. If the panels are installed by vertical folding a constant displacement resistance over the length of the tongue is desired. Also a high angle between the fold panel and the second panel when the fold panel initially contact the tongue in the second panel is provided. The protrusions are designed to allow displacement but also to prevent tilting of the tongue.

A floor panel is known from WO2006/043893, as mentioned above, and discloses a bow shaped flexible tongue bendable in the length direction. The drawback of this bow shaped tongue is that due to the shape, there is no locking at the end of the tongue. One embodiment is shown that provides locking along the whole length (FIG. 7*f*), but that tongue consists of two connected parts (38, 39). It is also important that the tongue easily springs back after being displaced into the displacement groove during installation. Therefore it is advantageously if the part of the tongue which cooperate with the adjacent panel is relatively stable and is provided with sliding surfaces with an area enough to avoid that the tongue get stuck before reaching its final position for vertical locking. A sliding surface at the tip of a tab or a protrusion is therefore not a useful solution.

Advantageously, the protrusions of the tongue are bow shaped, providing an essentially constant moment arm during installation of the panels and bending of the protrusions.

Preferably, the tongue comprises a recess at each protrusion, resulting in avoiding of deformation and cracking of the protrusion if the tongue is displaced too far and too much force is applied.

Preferably, the length of the tongue is of more than 90% of the width WS of front face of the panel; in other preferred embodiments the length of the tongue is preferably in the range from 75% to substantially the same as the width WS of front face.

A second embodiment of the invention provides for a tongue for a building panel, said tongue is of an elongated shape and made of molded plastic. The tongue comprises at least two protrusions at a first long edge of the tongue. The protrusions are bendable in a plane parallel to the upper surface of the tongue and extending essentially in the parallel plane. Furthermore, the tongue has a second long edge, which is essentially straight over substantially the whole length of the tongue.

A first advantage consists in that the tongue provides for locking in the vertical direction along the whole length of the tongue. A second advantage is that it is possible to mould the tongue in one part in plastic and if desired cutting the tongue in shorter tongues, which all have essentially the same properties. Especially the displacement resistance and the locking strength per length unit are essentially the same. A third advantage is that the displacement resistance, due to the bending of the protrusions are essentially the same along the whole tongue. A larger number of protrusions provides for a more constant displacement resistance along the edge of the tongue. Even rather rigid materials such as reinforced plastic, metals, for example aluminium and wood may be made flexible with protrusions according to the principle of the invention. If the panels are installed by vertical folding, e.g. by the installation method explained below (see FIG. 5), a constant displacement resistance is desired All references to "a/an/the [element, device, component, means, step, etc]" are to be interpreted openly as referring to at least one instance of said element, device, component, means, step, etc., unless explicitly stated otherwise.

DESCRIPTION OF EMBODIMENTS OF THE INVENTION

As represented in FIGS. 5-8, the disclosure relates to a set of floor panels with a displaceable tongue and displaceable tongue for a floor panel.

A prior art floor panel 1, 1' provided with a mechanical locking system and a displaceable tongue is described with reference to FIGS. 1*a*-1*d*.

Figure 1A:
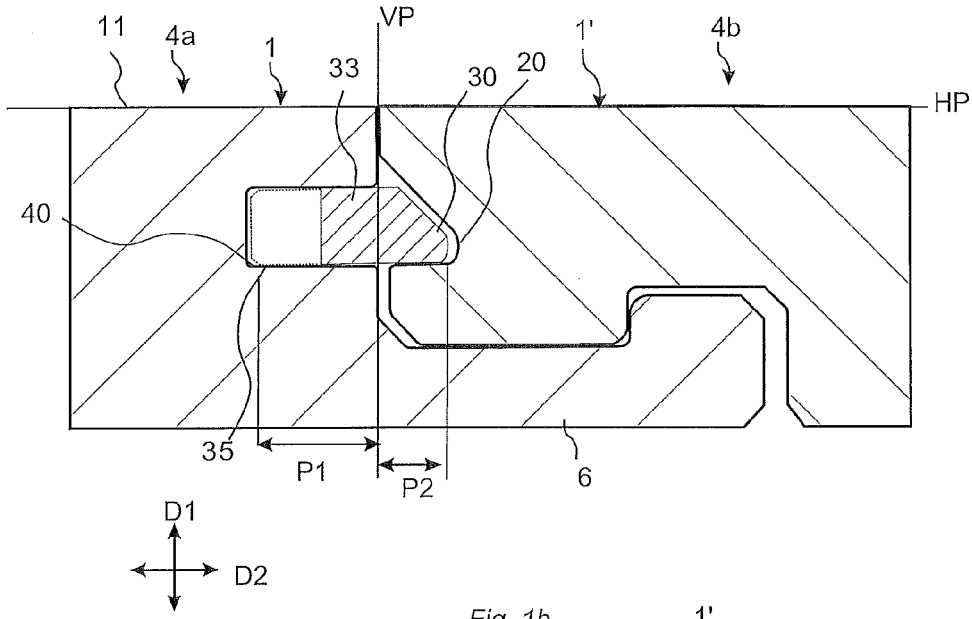
FIGS. 1*a-d* illustrate a prior art locking system
Figure 1B:
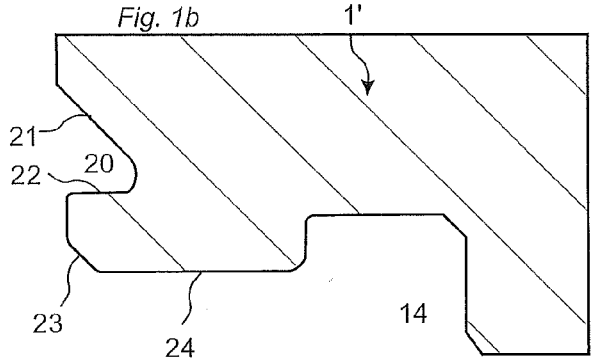
Figure 1C:
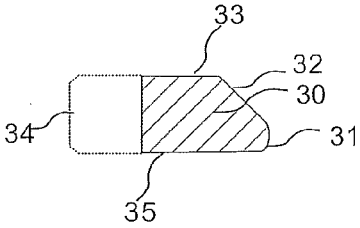
Figure 1D:
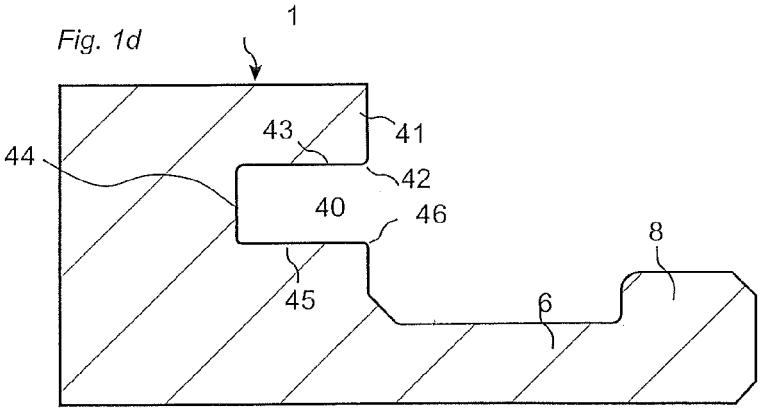

FIG. 1*a* illustrates schematically a cross-section of a joint between a short side joint edge 4*a* of a panel 1 and an opposite short side joint edge 4*b* of a second panel 1'.

The front faces of the panels are essentially positioned in a common horizontal plane HP, and the upper parts 21, 41 of the joint edges 4*a*, 4*b* abut against each other in a vertical plane VP. The mechanical locking system provides locking of the panels relative to each other in the vertical direction D1 as well as the horizontal direction D2.

To provide joining of the two joint edges in the D1 and D2 directions, the edges of the floor panel have in a manner known per se a locking strip 6 with a locking element 8 in one joint edge, hereafter referred to as the "strip panel" which cooperates with a locking groove 14 in the other joint edge, hereafter referred to as the "fold panel", and provides the horizontal locking.

The prior art mechanical locking system comprises a separate flexible tongue 30 fixed into a displacement groove 40 formed in one of the joint edges. The flexible tongue 30 has a groove portion P1, which is located in the displacement groove 40 and a projecting portion P2 projecting outside the displacement groove 40. The projecting portion P2 of the flexible tongue 30 in one of the joint edges cooperates with a tongue groove formed in the other joint edge.

The flexible tongue 30 has a protruding part P2 with a rounded outer part 31 and a sliding surface 32, which in this embodiment if formed like a bevel. It has upper 33 and lower 35 tongue displacement surfaces and an inner part 34.

The displacement groove 40 has an upper 42 and a lower 46 opening, which in this embodiment are rounded, a bottom 44 and upper 43 and lower 45 groove displacement surfaces, which preferably are essentially parallel with the horizontal plane HP.

The tongue groove 20 has a tongue-locking surface 22, which cooperates with the flexible tongue 30 and locks the joint edges in a vertical direction D1. The fold panel 1' has a vertical locking surface 24, which is closer to the rear face 62 than the tongue groove 20. The vertical locking surface 24 cooperates with the strip 6 and locks the joint edges in another vertical direction. The fold panel has in this embodiment a sliding surface 23 which cooperated during locking with the sliding surface 32 of the tongue.

Figure 3A:
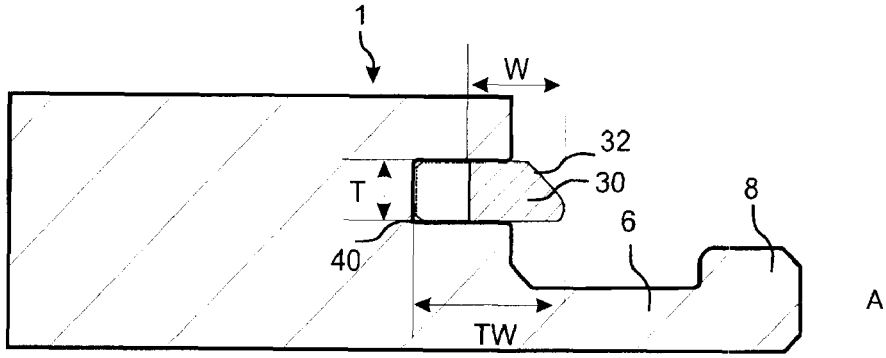
FIGS. 3*a-b* show a floor panels with a prior art mechanical locking system on a short side.
Figure 3B:
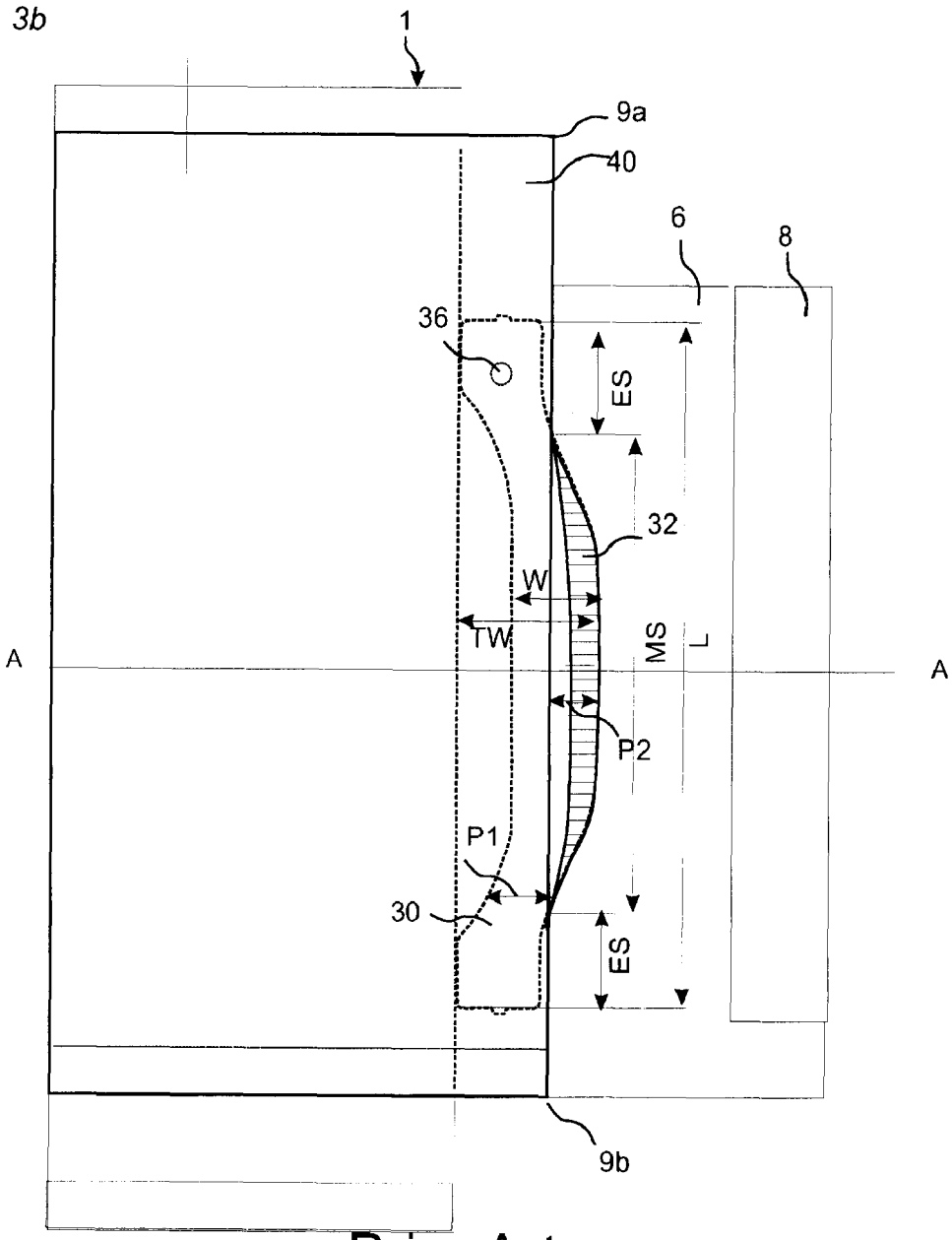

FIG. 3*a* shows a cross section A-A of a panel according to FIG. 3*b* seen from above. The flexible tongue 30 has a length L along the joint edge, a width W parallel to the horizontal plane and perpendicular to the length L and a thickness T in the vertical direction D1. The sum of the largest groove portion P1 and the largest protruding part P2 is the total width TW. The flexible tongue has also in this embodiment a middle section MS and two edge sections ES adjacent to the middle section. The size of the protruding part P2 and the groove portion P1 varies in this embodiment along the length L and the tongue is spaced from the two corner sections 9*a* and 9*b*. The flexible tongue 30 has on one of the edge sections a friction connection 36 which could be shaped for instance as a local small vertical protrusion. This friction connection keeps the flexible tongue in the displacement groove 40 during installation, or during production, packaging and transport, if the flexible tongue is integrated with the floor panel at the factory.

Figure 2A:
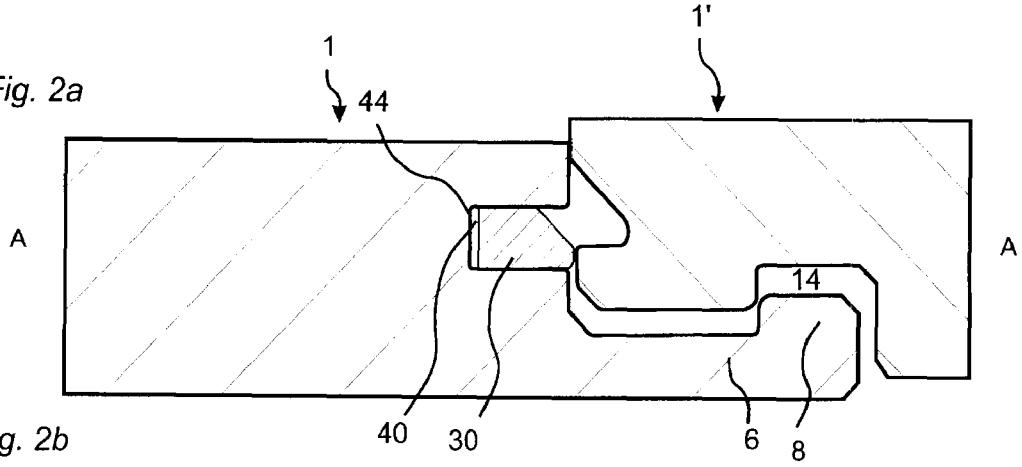
FIGS. 2*a-b* show a prior art flexible tongue during the locking action.
Figure 2B:
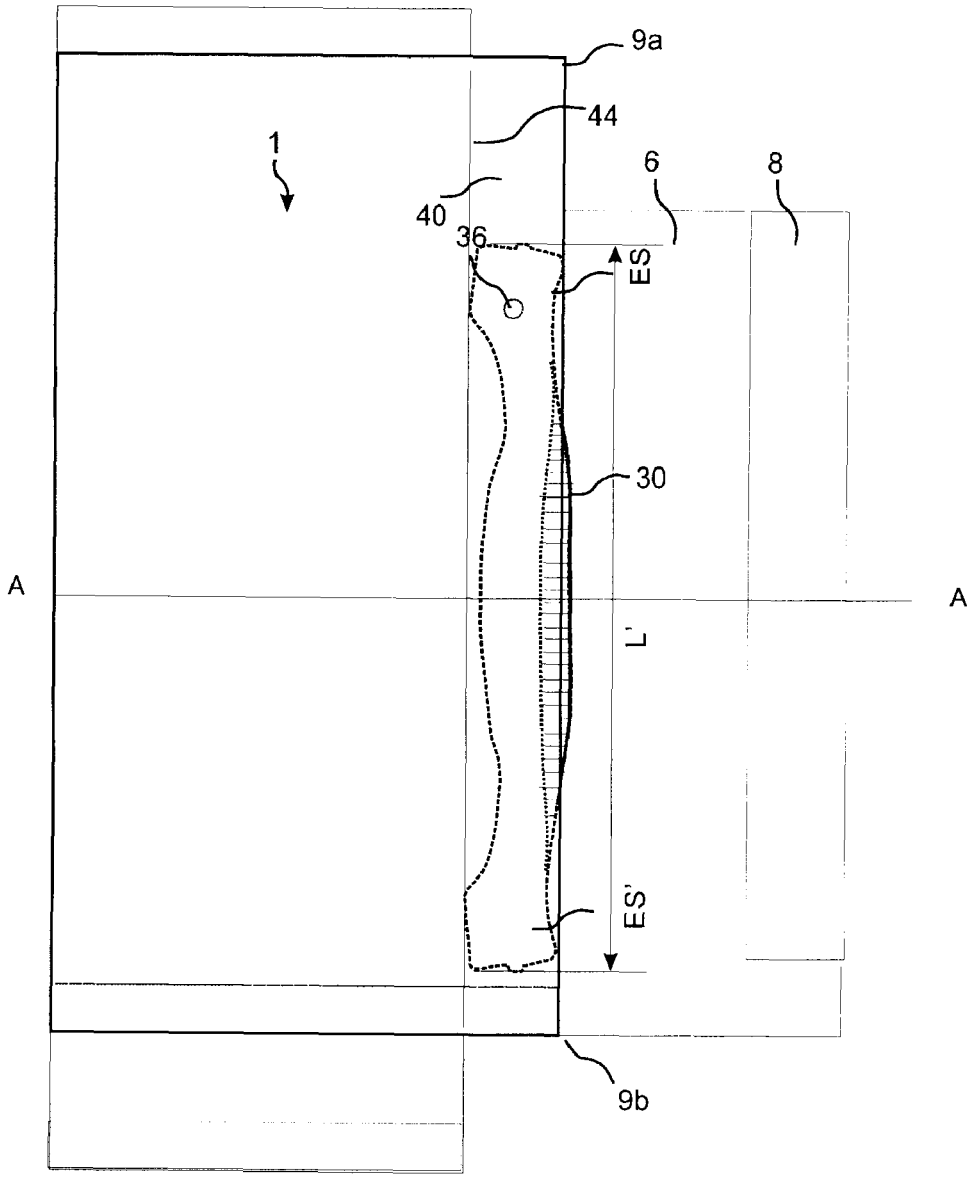

FIGS. 2*a* and 2*b* shows the position of the flexible tongue 30 after the first displacement towards the bottom 44 of the displacement groove 40. The displacement is caused essentially by bending of the flexible tongue 30 in its length direction L parallel to the width W. This feature is essential for this prior art.

The fold panel could be disconnected with a needle shaped tool, which could be inserted from the corner section 9*b* into the tongue grove 20 and press the flexible tongue back into the displacement groove 40. The fold panel could than be angled up while the strip panel is still on the sub floor. Of course the panels could also be disconnected in the traditional way.

Figure 4A:
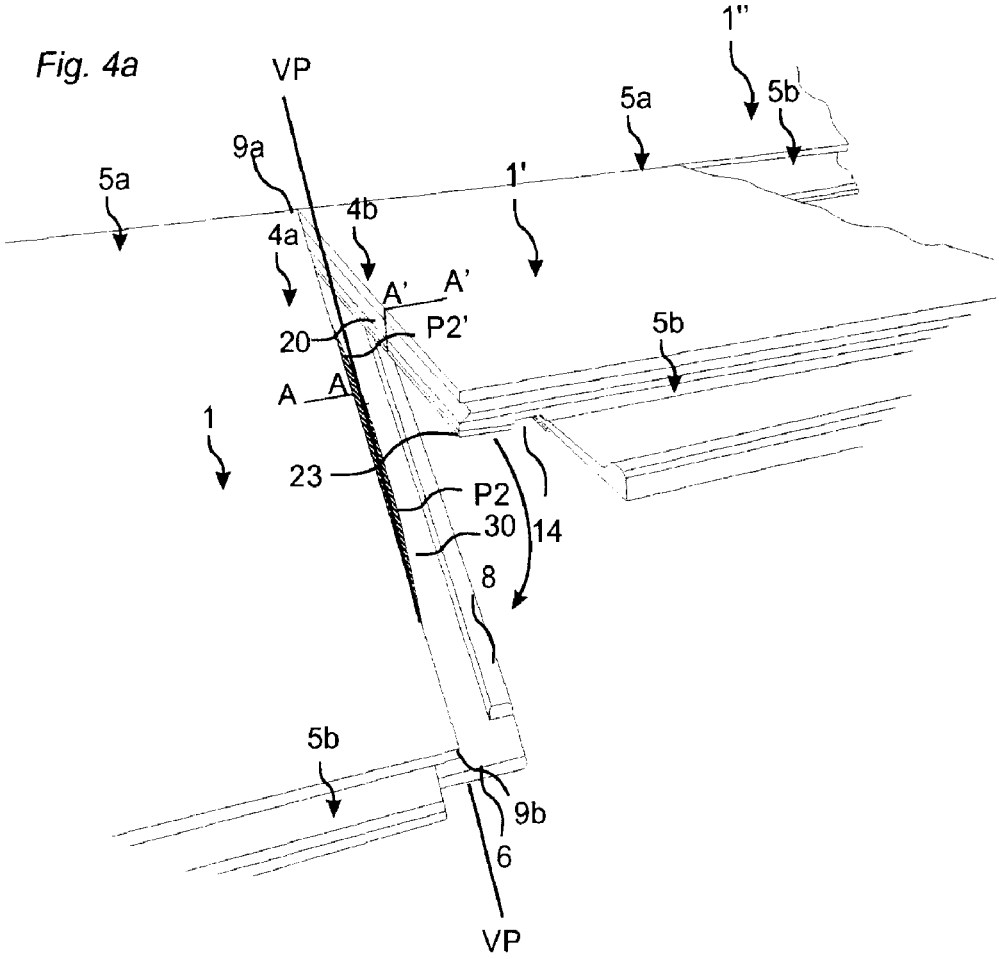
FIGS. 4*a-b* show how short sides of two floor panels could be locked with vertical folding according to prior art.
Figure 4B:
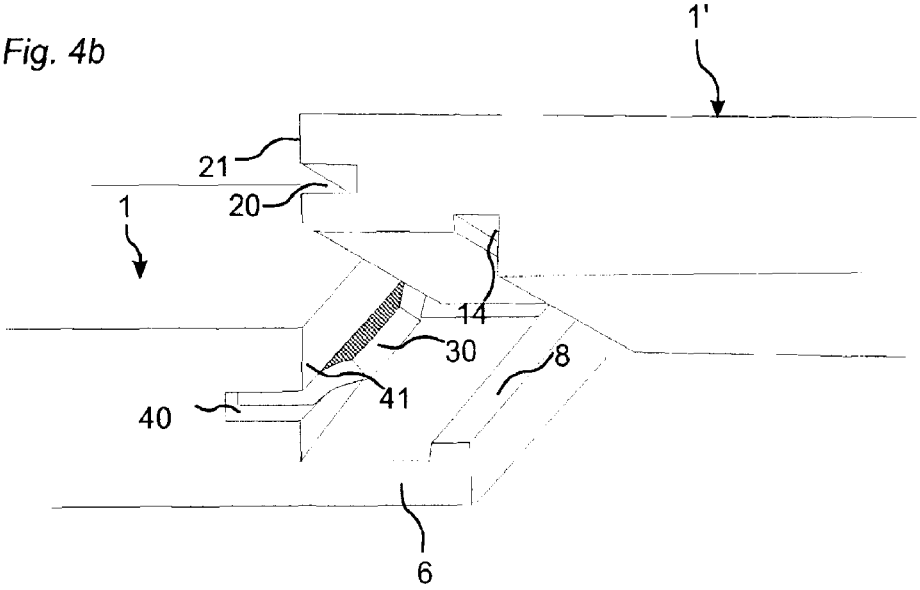

FIGS. 4*a* and 4*b* shows one embodiment of a vertical folding. A first panel 1" in a first row is connected to a second 1 panel in a second row. The new panel 1' is connected with its long side 5*a* to the long side 5*b* of the first panel with angling. This angling action also connects the short side 4*b* of the new pane with the short side 4*a* of the second panel. The fold panel 1' is locked to the strip panel 1 with a combined vertical and turning motion along the vertical plane VP. The protruding part P2 has a rounded and or angled folding part P2' which during folding cooperates with the sliding surface 23 of the folding panel 1'. The combined effect of a folding part P2', and a sliding surface 32 of the tongue which during the folding cooperates with the sliding surface 23 of the fold panel 1' facilitates the first displacement of the flexible tongue 30. An essential feature of this embodiment is the position of the projecting portion P2, which is spaced from the corner section 9*a* and 9*b*. The spacing is at least 10% of the length of the joint edge, in this case the visible short side 4*a*.

Figure 5A:
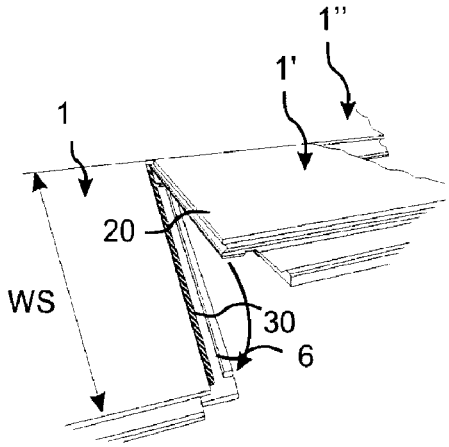
FIGS. 5*a-c* show panels according to one embodiment of the invention and a preferred locking method.
Figure 5B:
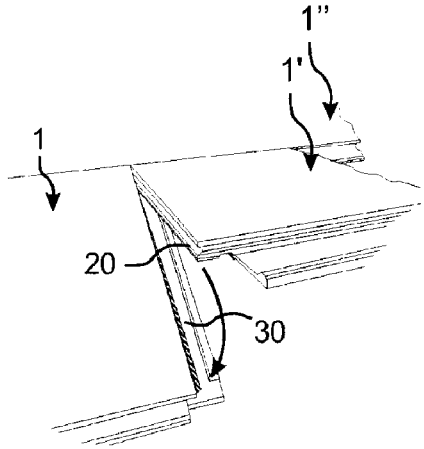
Figure 5C:
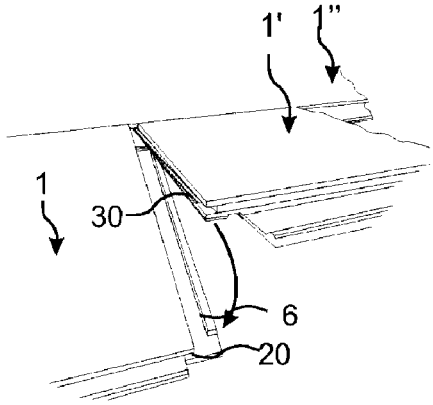

FIGS. 5*a*-5*c* show an embodiment of the set of floor panels with a displaceable tongue according to the invention and a preferred installation method. In this embodiment the length of the tongue is of more than 90% of the width WS of front face of the panel, in other preferred embodiments the length of the tongue is preferably in the range from 75% to substantially the same as the width WS of front face. Preferably, the length of the tongue is about the total width of the panel minus the width of the locking system of the adjacent edges of the panel. A small bevel may be provided at the ends of the outer edge, but the straight part of the tongue at the outer edge has preferably a length substantially equal to the length of the tongue or desirably more than 90%. The new panel 1' is in angled position with an upper part of the joint edge in contact with the first panel 1" in the first row. The new panel 1', is then displaced towards the second panel 1 until the edges are essentially in contact and a part of the flexible tongue 15 is pressed into the displacement groove 40 as can be seen in the FIG. 5*b*. The new panel 1' is then folded down towards the second panel 1. Since the displacement of the new panel 1' presses only an edge section of the flexible tongue 30 into the displacement groove 40, vertical folding will be possible to make with less resistance. Installation could be made with a displaceable tongue that has a straight outer edge. When panels with the known bow shaped tongue 30 (see FIG. 2-4) are installed the whole tongue has to be pressed into the displacement groove. When comparing the known bow shaped tongue with a tongue according to the invention less force is needed for a tongue with the same spring constant per length unit of the tongue. It is therefore possible, using the principles of the invention, to use a tongue with higher spring constant per length unit and higher spring back force, resulting in more reliable final position of the tongue. With this installation method the bevelled sliding surface of the fold panel is not necessary, or may be smaller, which is an advantage for thin panels. If the tongue is not long enough, the installation method above is not working and the bevelled sliding surface of the fold panel is needed. FIG. 5*c* show that the tongue could be on the folding panel.

A preferred production method according to the invention is injection moulding. With this production method a wide variety of complex three-dimensional shapes could be produced at low cost and the flexible tongues 30 may easily be connected to each other to form tongue blanks. A tongue could also be made of an extruded or machined plastic or metal section, which could be further shaped with for example punching to form a flexible tongue according to the invention. The drawback with extrusion, besides the additional productions steps, is that it is hard to reinforce the tongue, e.g. by fibres.

As can be seen when comparing FIGS. 5 and 4, the angle between the new panel 1' and the second panel 1 is higher, for the panels with the tongue according to an embodiment of the invention, when the new panel initially contacts the end of the tongue 30 and begins to displace the tongue into the displacement groove 40. It is an advantage if the angle is higher, since a higher angle means a more comfortable working position in which it is easier to apply a higher force pushing the tongue into the displacement groove.

Any type of polymer materials could be used such as PA (nylon), polyoxymethylene (POM), polycarbonate (PC), polypropylene (PP), Polyethyleneterephthalate (PET) or polyethylene (PE) or similar having the properties described above in the different embodiments. These plastic materials could be when injection moulding is used be reinforced with for instance glass fibre, Kevlar fibre, carbon fibre or talk or chalk. A preferred material is glass fibre, preferably extra long, reinforced PP or POM.

FIG. 6*a*-*e* shows embodiments of the tongue 15 according to the invention. They are all configured to be inserted in a groove in a floor panel, in a similar way as described for the prior art tongues and panels in reference to FIGS. 1-4 above. All methods to injection mould, insert and also the tool for disassembling described in WO2006/043893 and partly in the description and FIGS. 1-4 above are applicable to the invention.

Figure 6A:
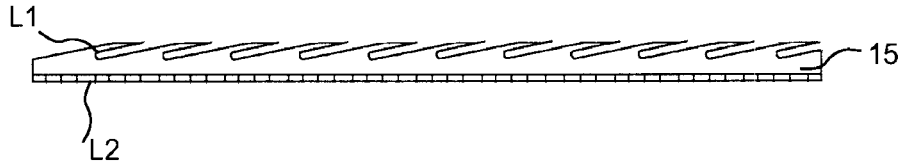
FIGS. 6*a-e* show displaceable tongues in embodiments according to the invention.

FIG. 6*a* shows an embodiment with a first long edge L1 and a second long edge L2. The first long edge has protrusions extending in a plane parallel to the topside 64 of the tongue 30 and with an angle relative the longitudinal direction of the tongue.

Figure 6B:
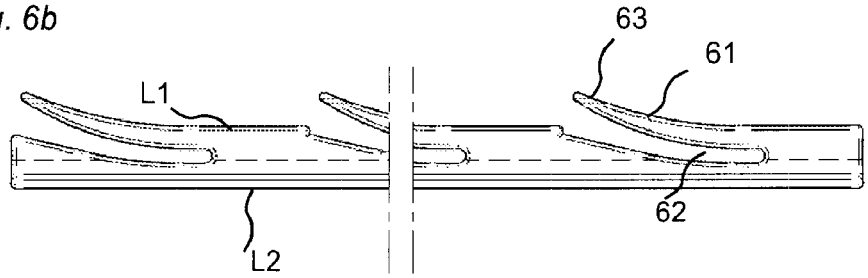

FIGS. 6*a-b* show the embodiment, in top and in a side view, with a first long edge L1 and a second long edge L2. The first long edge has protrusions 61 extending in a plane parallel to the topside, an upper displacement surface, and rear side, a lower displacement surface, of the tongue and with an angle relative the longitudinal direction of the tongue. The protrusions are preferably bow shaped and, in a particular preferred embodiment, the tongue is provided with a recess 62 at each protrusion 61. The recess is preferably adapted to the size and shape of the protrusion.

The protrusions are preferably provided with a friction connection 63, most preferably close to or at the tip of the protrusion, which could be shaped for instance as a local small vertical protrusion. This friction connection keeps the flexible tongue in the displacement groove 40 during installation, or during production, packaging and transport, if the displaceable tongue is integrated with the floor panel at the factory.

Figure 6C:
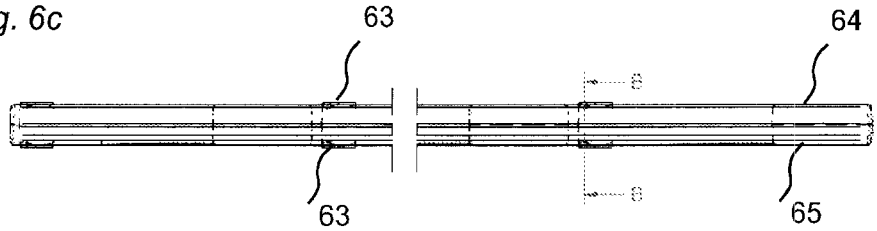
Figure 6D:
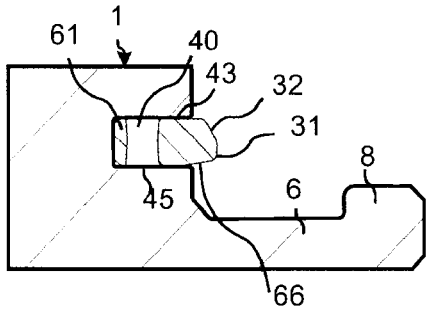

FIG. 6*d* shows the tongue in the cross section B-B in FIG. 6*c* and positioned in the displacement groove 40 of a panel 1. The upper and lower displacement surface of the tongue is configured to cooperate with an upper 43 and a lower 45 groove displacement surfaces. The panel comprising a locking strip 6 and a locking element 8 for horizontal locking. The panel 1 is configured to be connected to a second panel 1' in a similar way as the prior art panel 1' in FIG. 1*a*-1*d*. The upper displacement surface (64) and/or the lower displacement surface (65) of the tongue is in one preferred embodiment provided with a bevelled edge, presenting an upper sliding surface 32 and lower sliding surface 31, and an inclined locking surface (66), respectively. The inclined locking surface cooperates preferably with an inclined tongue-locking surface 22 in the tongue groove (20).

Figure 6E:
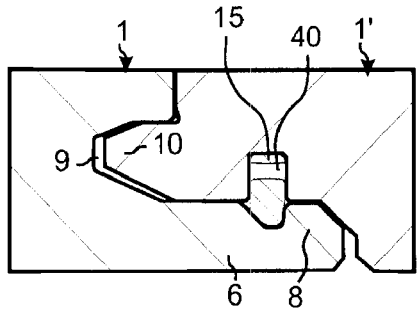

In embodiments according to FIGS. 6*d* and 6*e*, the displacement groove (40) is formed in one piece with the core of the panel, but other alternatives are possible. The displacement groove may be formed in a separate material, for example HDF, which is connected to a wood core in a parquet floor. The displacement grove may be formed of U-shaped plastic or metal sections, which are connected to the panel with for example a snap connection, glue or friction. These alternatives could be used to reduce friction and to facilitate horizontal displacement of the tongue in the displacement grove. The displacement groove may also be treated with a friction reducing agent. These principles may also be applied to the tongue groove.

FIG. 6*e* shows that the tongue 30 may also be inserted into the displacement groove 40 of a panel for locking in the horizontal plane. The tongue is displaced in the vertical plane during connection of the panels. These type of panels are connected by a movement in the horizontal plane—"horizontal snapping".

Figure 8A:
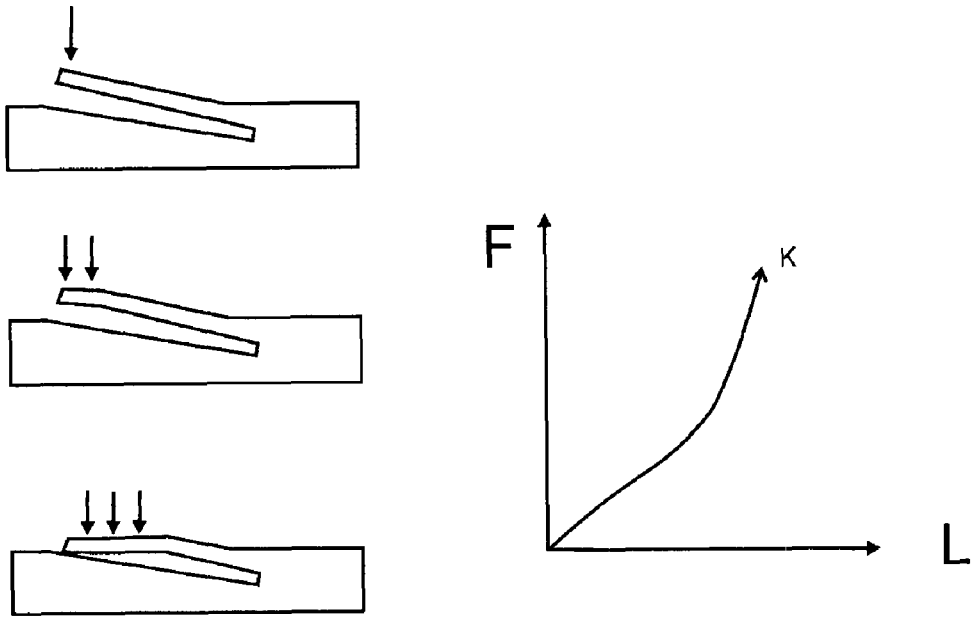
FIGS. 8*a-b* show the bending of the protrusion of the tongue, during installation, according to embodiments of the invention.
Figure 8B:
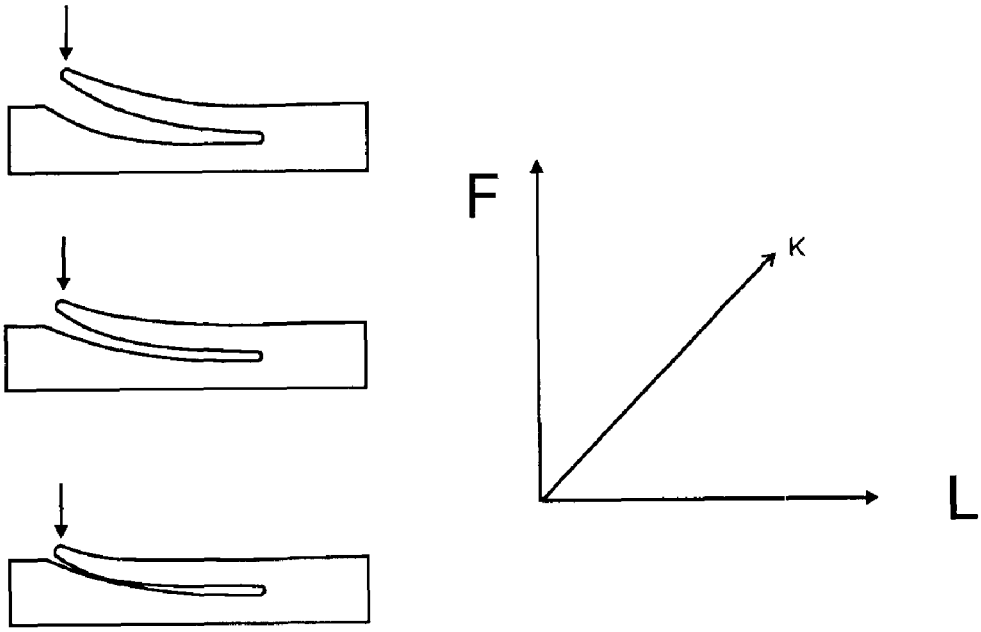

To facilitate the installation it is advantageous if the spring constant of the protruding part is as linear as possible. A linear spring constant results in a nice and smooth connection movement without suddenly or heavily increased displacement resistant. According to one embodiment, this is achieved by a bow shaped protrusion. FIG. 8*b* shows that a bow shaped protrusion results in an essentially constant moment arm, the force is during the whole course of connecting two panels at the tip of the protrusion, and a essentially linear spring constant. FIG. 8*a* shows that a straight protrusion results in that the moment arm is changed during the course; the force is spread out over a larger part of the length of the protrusion, resulting in an increased spring constant during the course. F is the displacement force and L is the displaced distance.

The preferred recess at the protrusion has the advantage that the protrusion is not destroyed if too much force is applied or the tongue is displaced too far. The protrusion is pushed into the recess and a cracking of the protrusion is avoided.

Figure 7A:
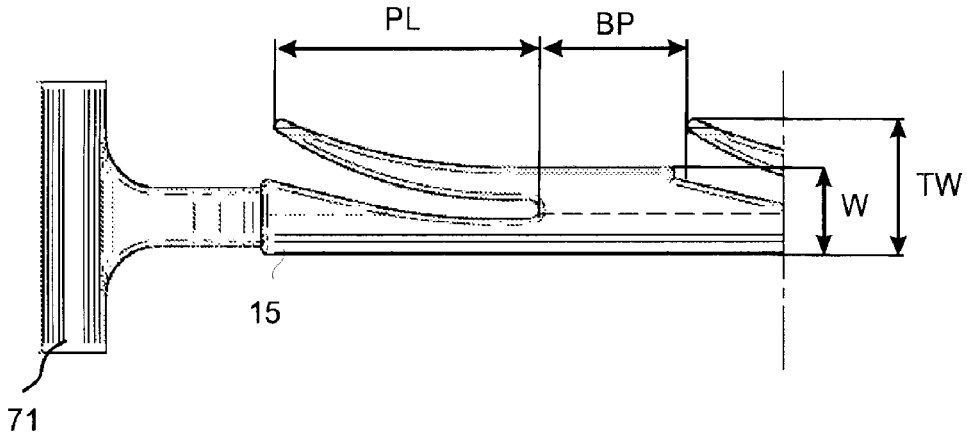
FIGS. 7*a-b* show the displaceable tongues in an embodiment according to the invention in a top view and a 3D view
Figure 7B:
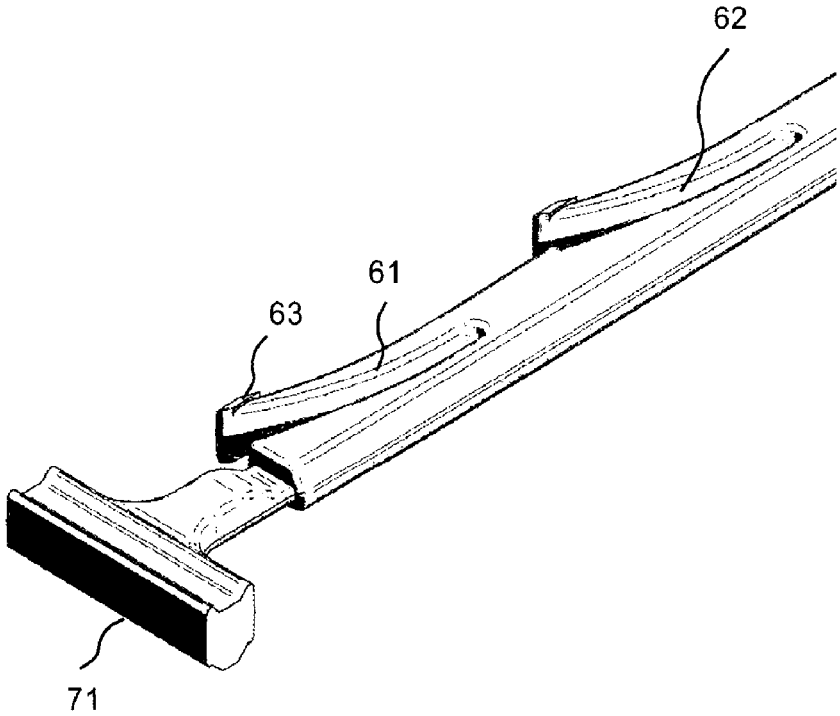

FIGS. 7*a-b* show two enlarged embodiments of a part of the tongue in a top view and in a 3D view. The figures show a casting gate 71 which is cut off before insertion into the displacement groove.

It is preferred that the length of the protrusion PL is larger than the total width TW of the tongue. The total width is the width of the tongue W plus the distance from the tongue body to the tip of the protrusion perpendicular to the length direction of the tongue. In the most preferred embodiment, PL is larger than 2*TW. It is also preferred that the recess is wider near the tip of the protrusion than near the bottom of the recess; as shown I FIG. 7*a*.

Preferably, the force to displace the tongue 1 mm (0.039 inches) is per 100 mm (3.937 inches) length of the tongue in the range of about 20 to about 30 N.

Preferably the length of the protrusion PL is in the range of about 10 mm (0.394 inches) to about 20 mm (0.787 inches), the width W of the tongue is in the range of about 3 mm (0.118 inches) to about 6 mm (0.236 inches) and the total width TW of the tongue is in the range of about 5 mm (0.197 inches) to about 11 mm (0.433 inches). The length of the body part BP between two protrusions, i.e. the distance from the root of one protrusion to the tip of an adjacent protrusion, is in the range of about 3 mm (0.118 inches) to about 10 mm (0.394 inches). As a non limiting example, for a width of a floor panel of about 200 mm (7.874 inches), including the width of the locking system at adjacent edges, with a tongue length of about 180 mm (7.087 inches), having 9 protrusions the protrusion length is about 15 mm (0.591 inches), the length of the body part BP is about 5 mm (0.197 inches), the width of the tongue W is about 5 mm (0.197 inches) and the total width TW is about 8 mm (0.315 inches).

The tongues according to the embodiments of the invention are all possible to mould in one piece. It is further possible to cut the molded tongue in shorter pieces which all have the same properties per length unit, provided that the number of protrusions is not to few.

Preferably, the force to displace the tongue 1 mm is per 100 mm length of the tongue in the range of about 20 to about 30 N.

The invention claimed is:

1. A set of essentially identical floor panels, each of the floor panels comprising first and second connectors which are integrated with the floor panels and configured to connect a first floor panel to a second floor panel so that upper joint edges of said first and second floor panels in the connected state define a vertical plane, the first connector comprising an upwardly directed locking element at one of the floor panels cooperating with a locking groove in the other of said floor panels for connecting said first floor panel with said second floor panel in a horizontal direction perpendicular to said vertical plane, the second connector comprising a flexible tongue of molded plastic in a displacement groove in an edge of one of the floor panels, the displacement groove including an upper wall, a lower wall, and a side wall connecting the upper and lower walls, the flexible tongue is configured to cooperate with a tongue groove in the other of said floor panels for locking the floor panels together in a vertical direction parallel to the vertical plane, the flexible tongue is displaceable in the horizontal direction in the displacement groove, the tongue comprising at least two protrusions at a first long edge of the tongue, bendable in the horizontal plane, and extending essentially in the horizontal direction, the first long edge of the tongue is in the displacement groove and faces the sidewall, and the tongue has a second long edge which in the connected state extends outside the displacement groove beyond the vertical plane and the outer edge of the second long edge is essentially straight over substantially the whole length of the tongue.

2. The set of floor panels as claimed in claim 1, wherein there is an angle between each of the at least two protrusions and the longitudinal direction of the tongue.

3. The set of floor panels as claimed in claim 1, wherein the protrusions are bow shaped.

4. The set of floor panels as claimed in claim 1, wherein the protrusions extend into the displacement groove.

5. The set of floor panels as claimed in claim 1, wherein the first floor panel is configured to be locked to the second floor panel with vertical folding or solely vertical movement.

6. The set of floor panels as claimed in claim 1, wherein the length of the tongue is more than 75% of the width of the front face of the floor panels.

7. The set of floor panels as claimed in claim 1, wherein the length of the tongue is more than 90% of the width of the front face of the floor panels.

8. The set of floor panels as claimed in claim 1, wherein the length of the tongue is substantially the same as the width of the front face of the floor panels.

9. The set of floor panels as claimed in claim 1, wherein the first long edge of the tongue comprises a recess at each protrusion.

10. The set of floor panels as claimed in claim 1, wherein the essentially straight edge of the tongue is continuous.

11. A tongue for a building panel, said tongue is of an elongated shape and made of molded plastic, wherein the tongue comprises a plurality of protrusions at a first long edge of the tongue, the first long edge of the tongue comprising a respective recess at each protrusion, and the protrusions are bendable in a plane parallel to the upper surface of the tongue and extend essentially in the parallel plane, at least two protrusions extend in the same direction along a longitudinal direction of the tongue, at least a portion of each protrusion is adapted to contact an inner surface of the respective recess when the protrusions bend in the plane parallel to the upper surface of the tongue, and the tongue has a second long edge, which is essentially straight over substantially the whole length of the tongue.

12. The tongue as claimed in claim 11, wherein there is an angle between each of the protrusions and the longitudinal direction of the tongue.

13. The tongue as claimed in claim 11, wherein the protrusions are configured to extend into a displacement groove of the floor panel.

14. The tongue as claimed in claim 11, wherein the size of the recess is adapted to the size of the protrusion.

15. The tongue as claimed in claim 11, wherein the shape of the recess is adapted to the shape the protrusion.

16. The tongue as claimed in claim 11, wherein the essentially straight edge of the tongue is continuous.

17. The tongue as claimed in claim 11, wherein the upper and lower surface of the tongue are displacement surfaces.

18. The tongue as claimed in claim 11, wherein the upper displacement surface and/or the lower displacement surface has/have a bevelled edge, presenting a sliding surface and an inclined locking surface, respectively.

19. The tongue as claimed in claim 11, wherein a vertical protrusion is arranged at the upper side and/or at the lower side of each of the protrusions.

20. The tongue as claimed in claim 19, wherein the vertical protrusion is arranged close to or at the tip of each of the protrusions.

21. The tongue as claimed in claim 11, wherein tongue is made PP or POM, and reinforced with fibres.

22. The tongue as claimed in claim 11, wherein the building panel is a floor panel.

23. The tongue as claimed in claim 11, wherein the displacement groove is made of a different material than the core of the panel.

24. The tongue as claimed in claim 11 wherein the length of the protrusion is larger than the total width of the tongue, whereby the total width is the width of the tongue plus the distance from the tongue body to the tip of the protrusion perpendicular to the length direction of the tongue.

25. The tongue as claimed in claim 24 wherein the length of the protrusion is larger than two times the total width of the tongue.

26. The tongue as claimed in claim 11, wherein force to compress the tongue 1 mm in the width direction is per 100 mm length of the tongue in the range of about 20 to about 30 N.

27. The tongue as claimed in claim 11, wherein tongue is made PP or POM, and reinforced with glass fibres.

28. A tongue for a building panel, said tongue is of an elongated shape and made of molded plastic, wherein the tongue comprises a plurality of protrusions at a first long edge of the tongue, the first long edge of the tongue comprising a respective recess at each protrusion, and the protrusions are bendable in a plane parallel to the upper surface of the tongue, extend essentially in the parallel plane and are bow shaped along a longitudinal axis of the tongue, at least two protrusions extend in the same direction along a longitudinal direction of the tongue, at least a portion of each protrusion is adapted to contact an inner surface of the respective recess when the protrusions bend in the plane parallel to the upper surface of the tongue, and the tongue has a second long edge, which is essentially straight over substantially the whole length of the tongue.

29. A tongue for a building panel, said tongue is of an elongated shape and made of molded plastic, wherein the tongue comprises at least two protrusions at a first long edge of the tongue, the first long edge of the tongue comprising a respective recess at each protrusion, and the protrusions are bendable in a plane parallel to the upper surface of the tongue and all extend in the same direction along a longitudinal direction of the tongue and essentially in the parallel plane, at least a portion of each protrusion is adapted to contact an inner surface of the respective recess when the protrusions bend in the plane parallel to the upper surface of the tongue, and the tongue has a second long edge, which is essentially straight over substantially the whole length of the tongue.

* * * * *

UNITED STATES PATENT AND TRADEMARK OFFICE

CERTIFICATE OF CORRECTION

PATENT NO. : 7,908,815 B2
APPLICATION NO. : 11/775885
DATED : March 22, 2011
INVENTOR(S) : Darko Pervan and Agne Palsson It is certified that error appears in the above-identified patent and that said Letters Patent is hereby corrected as shown below:

Title Page, at item (75) Inventors, please correct the spelling of inventor Agne Palsson, wherein "Paisson" should be changed to --Palsson--.

Signed and Sealed this
Twentieth Day of September, 2011

David J. Kappos

David J. Kappos
*Director of the United States Patent and Trademark Office*